United States Patent [19]

Shu et al.

[11] 4,450,911

[45] May 29, 1984

[54] VISCOUS OIL RECOVERY METHOD

[75] Inventors: Winston R. Shu, Dallas; Kathy J. Hartman, Arlington, both of Tex.

[73] Assignee: Mobil Oil Corporation, New York, N.Y.

[21] Appl. No.: 400,178

[22] Filed: Jul. 20, 1982

[51] Int. Cl.[3] ..... E21B 43/24

[52] U.S. Cl. ..... 166/263; 166/272

[58] Field of Search ..... 166/263, 272

[56] References Cited

U.S. PATENT DOCUMENTS

| | | | |
|---|---|---|---|
| 3,042,114 | 7/1962 | Willman | 166/272 |
| 3,280,909 | 10/1966 | Closmann et al. | 166/263 |
| 3,353,598 | 11/1967 | Smith | 166/272 X |
| 3,354,954 | 11/1967 | Buxton | 166/263 X |
| 3,385,360 | 5/1968 | Smith | 166/272 |
| 3,483,924 | 12/1969 | Blevins et al. | 166/272 |
| 3,960,213 | 6/1976 | Striegler et al. | 166/272 |
| 4,060,129 | 11/1977 | Gomaa et al. | 166/272 X |
| 4,099,783 | 7/1978 | Verty et al. | 166/272 X |
| 4,148,359 | 4/1979 | Laumbach et al. | 166/272 X |
| 4,386,658 | 6/1983 | Hunt | 166/272 X |

FOREIGN PATENT DOCUMENTS

| | | | |
|---|---|---|---|
| 1112956 | 5/1968 | United Kingdom | 166/272 |

*Primary Examiner*—George A. Suchfield

*Attorney, Agent, or Firm*—Alexander J. McKillop; Michael G. Gilman; Lawrence O. Miller

[57] ABSTRACT

In a thermal method for the recovery of oil from a subterranean, viscous oil-containing formation, steam in an amount ranging from 0.3 to 0.5 pore volume and an injection rate within the range of 4.0 to 7.0 bbl/day/ac.-ft. is injected into the formation via an injection well completed in the lower 50% or less of the formation and fluids including oil are recovered via a spaced-apart production well completed in the upper 50% or less of the formation. The injection well is then shut-in for a variable time and thereafter a predetermined amount of hot water or low quality steam is injected into the formation via the injection well in an amount ranging from 0.03 to 0.10 pore volume and at an injection rate of 1 to 2.0 bbl/day/ac.-ft. The method is applied to viscous oil-containing formation in which either naturally occurring or induced communication exists between the injection well and the production well in the bottom zone of the formation. The injection well and production well are spaced apart 400 to 750 feet.

10 Claims, 4 Drawing Figures

VISCOUS OIL RECOVERY METHOD

FIELD AND BACKGROUND OF THE INVENTION

1. Field of the Invention

This invention relates to a process for recovering oil from a subterranean, viscous oil-containing formation. More particularly, this invention relates to a thermal method for recovering oil from a viscous oil-containing formation employing optimum well distances, selected well completions, and a sequence of manipulation steps with steam and hot water to maximize heat utilization and enhance oil recovery.

2. Background of the Invention

Increasing worldwide demand for petroleum products, combined with continuously increasing prices for petroleum and products recovered therefrom, has prompted a renewed interest in the sources of hydrocarbons which are less accessible than crude oil of the Middle East and other countries. One of the largest deposits of such sources of hydrocarbons comprises tar sands and oil shale deposits found in Northern Alberta, Cananda, and in the Midwest and Western states of the United States. While the estimated deposits of hydrocarbons contained in tar sands are enormous (e.g., the estimated total of the deposits in Alberta, Canada is 250 billion barrels of synthetic crude equivalent), only a small proportion of such deposits can be recovered by currently available mining technologies (e.g., by strip mining). For example, in 1974 it was estimated that not more than about 10% of the then estimated 250 billion barrels of synthetic crude equivalent of deposits in Alberta, Canada was recoverable by the then available mining technologies. (See SYNTHETIC FUELS, March 1947, pages 3-1 through 3-14). The remaining about 90% of the deposits must be recovered by various in-situ techniques such as electrical resistance heating, steam injection and in-situ forward and reverse combustion.

Of the aforementioned in-situ recovery methods, steam flooding has been a widely-applied method for heavy oil recovery. Problems arise, however, when one attempts to apply the process to heavy oil reservoirs with very low transmissibility such as tar sand deposits. In such cases, because of the unfavorable mobility ratio, steam channelling and gravity override often result in early steam breakthrough and leave a large portion of the reservoir unswept. The key to a successful steam flooding lies in striking a good balance between the rate of displacement and the rate of heat transfer which lowers the oil viscosity to a more favorable mobility ratio.

In copending application to W. R. Shu et al, Ser. No. 320,236, filed Nov. 12, 1981, there is disclosed a thermal method for the recovery of oil from a subterranean, viscous oil-containing formation, in which a predetermined amount of steam in an amount not greater than 1.0 pore volume is injected into the formation via an injection well and oil is produced from the formation via a production well. The injection well is then shut-in for a variable time to allow the injected steam to dissipate its heat throughout the formation and reduce oil viscosity while continuing production of oil. A predetermined amount of hot water or low quality steam in an amount not greater than 1.0 pore volume is injected into the formation with continued production but avoiding steam breakthrough. Thereafter, production is continued until there is an unfavorable amount of water or steam in fluids recovered.

Accordingly, this invention provides an improved thermal system for effectively recovering oil from subterranean, viscous oil-containing formations employing optimum well distances, selected injection and production well completions, and manipulative steps of injecting various slug sizes of steam and hot water to obtain maximum heat utilization and enhanced oil recovery.

SUMMARY OF THE INVENTION

We have discovered that viscous oil may be recovered from a subterranean, viscous oil-containing formation having fluid communication in the bottom zone of the formation between at least one injection well in fluid communication with the lower 50% or less of the formation and at least one spaced-apart production well at a predetermined distance in fluid communication with the upper 50% or less of the formation. The injection well and production well are spaced-apart a distance within the range of 280 to about 680 feet. A predetermined amount of steam, preferably within the range of 0.3 to 0.5 pore volume and most preferably 0.37 pore volume, is injected into the injection well at a predetermined rate, preferably within the range of 4.0 to 7.0 barrels per day per acre-foot and most preferably 5.0 bbl/day/ac.-ft. Thereafter, the injection well is shut-in for a predetermined period of time and fluids including oil are recovered from the formation via the production well. Thereafter, a predetermined amount of hot water or low quality steam, less than 20% quality, in an amount within the range of 0.03 to 0.10 pore volume is injected into the injection well at an injection rate within the range of 1.0 to 2.0 barrels per day per acre-foot. Production is continued until there is an unfavorable amount of steam or water in the fluids recovered from the production well, preferably at least 90% water.

DESCRIPTION OF THE PREFERRED EMBODIMENT

Figure 1:
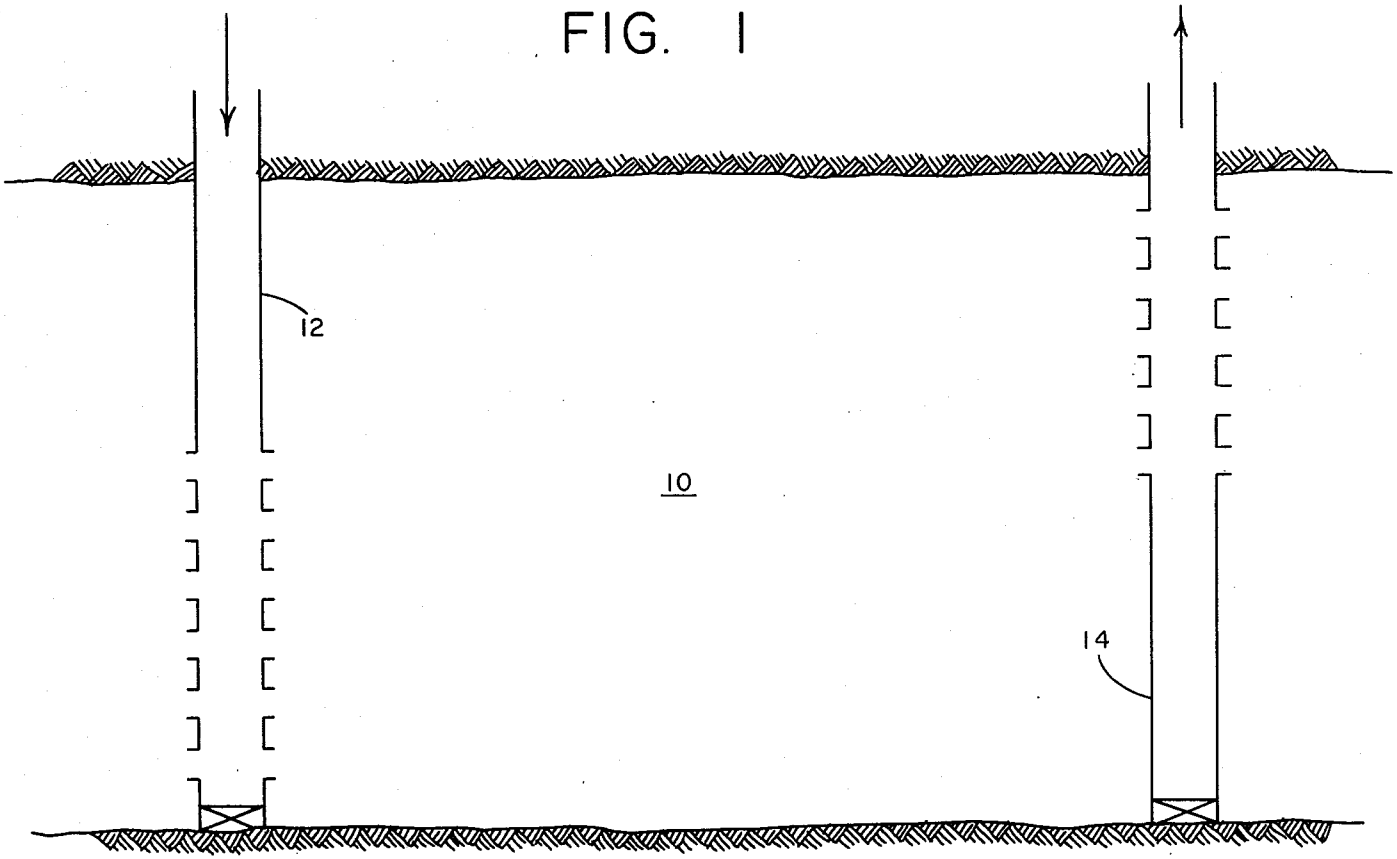
FIG. 1 shows a subterranean, viscous oil-containing formation penetrated by an injection well completed in the lower 50% or less of the formation and a production well completed in the upper 50% or less of the formation for carrying out the process of our invention.

Referring to FIG. 1, there is shown a subterranean, viscous oil-containing formation 10 penetrated by at least one injection well 12 and at least one spaced-apart production well 14. Injection well 12 is perforated or other fluid flow communication is established between the well as shown in FIG. 1 only with the lower 50% or less of the vertical thickness of the formation. Production well 14 is completed in fluid communication with the upper 50% or less of the vertical thickness of the formation. While recovery of the type contemplated by the present invention may be carried out by employing only two wells, it is to be understood that the invention is not limited to any particular number of wells. The invention may be practiced using a variety of well patterns as is well known in the art of oil recovery, such as an inverted five spot pattern in which an injection well is surrounded with four production wells, or in a line drive arrangement in which a series of aligned injection wells and a series of aligned production wells are utilized. Any number of wells which may be arranged according to any pattern may be applied in using the present method as illustrated in U.S. Pat. No. 3,927,716 to Burdyn et al, the disclosure of which is hereby incorporated by reference. Either naturally occurring or artificially induced fluid communication should exist between the injection well 12 and the production well 14 in the lower part of the oil-containing formation 10. Fluid communication can be induced by techniques such as cyclic steam or solvent stimulation or fracturing of the injection well and the production well.

The optimum distance between the injection well 12 and the production well 14 is determined for the particular well pattern selected which should vary from about 280 to about 680 feet. If the walls are too close together, steam breakthrough is hastened and prevents efficient sweep. If the wells are too far apart, formation communication is usually limited.

In the first step, a predetermined amount of steam, ranging from 0.3 to 0.5 pore volume, preferably 0.37 pore volume, is injected into the lower 50% or less of the formation 10 via injection well 12. The steam is injected at a predetermined rate ranging from 4.0 to 7.0 barrels per day per acre-foot, preferably about 5.0 bbl/day/ac-ft. Fluids including oil are recovered from the upper 50% or less of the formation 10 via production well 14 at the maximum flow rate, with or without stimulation. Because of the transmissibility of the formation, intially the total fluid production rate will be much less than the injection rate of steam and the formation pressure will build up. During the injection of the steam, the low completion interval in the injection well 12 and the high injection rate allows the generation of a steam/hot water finger low in the formation to increase vertical sweep efficiency, that is, the portion of the vertical thickness of the formation through which the injected displacement fluid passes.

After a predetermined amount of steam has been injected, injection well 12 is shut-in for a predetermined period of time while continuing to recover fluids including oil from the production well 14. This soak period allows time for the heat to dissipate into the formation and reduce viscosity of the oil. The high completion zone in the production well 14 allows a vertical growth of the steam zone originating from the low viscous finger as pressure in the formation 10 decreases and the steam rises by gravity in the formation. As the heated zone grows, the rate of production increases and the formation pressure is drawn down.

After the soak period, a predetermined amount of a fluid comprising hot water or low quality steam is injected into the formation 10 via the injection well 12. The quality of the steam is not greater than 20%. The amount of hot water or steam injected ranges from 0.03 to 0.10 pore volume and at an injection rate of 1 to about 2.0 bbl/day/ac-ft. Injection of the hot water or low quality steam causes the formation pressure to build up thereby enhancing oil recovery. Also, a hot water slug, unlike steam, does not overide in the formation but is able to scavenge heat from the steam already present causing the steam to condense so as to minimize steam channelling. This mechanism extends the production time by delaying steam breakthrough at the production well 14 thereby increasing oil recovery. Injection of slugs of hot water or low quality steam in the amount specified may be repeated if desired for a plurality of cycles. Thereafter, recovery of fluids including oil is continued until the fluids being recovered from the production well 14 contains an unfavorable amount of steam or water; preferably at least 90% water.

Utilizing a computer model which simulates formation performance during thermal recovery, we performed the following experiment to demonstrate the technical superiority of our method.

EXAMPLE 1

Figure 2:
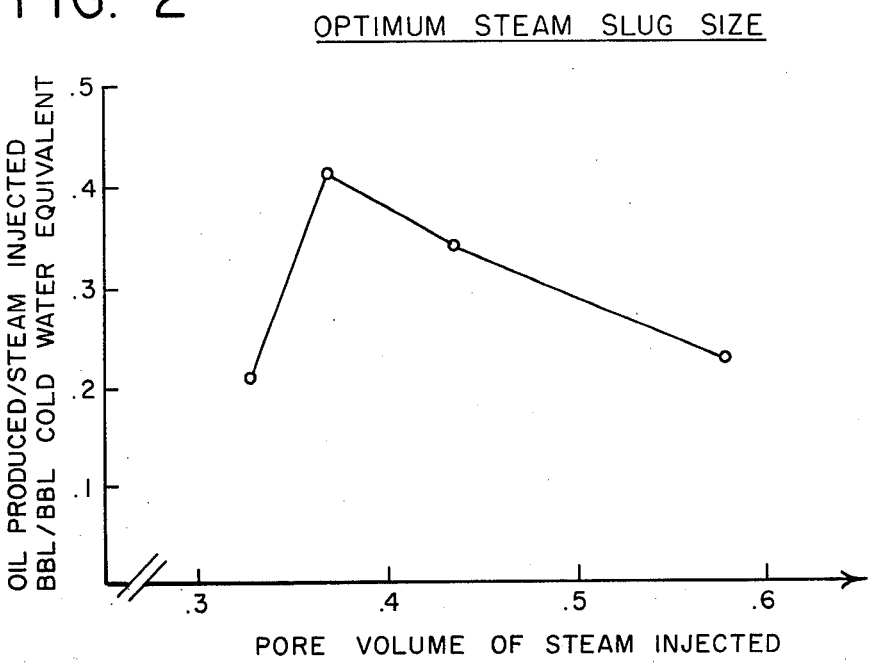
FIG. 2 illustrates the percent oil recovery versus steam pore volume injected.
Figure 3:
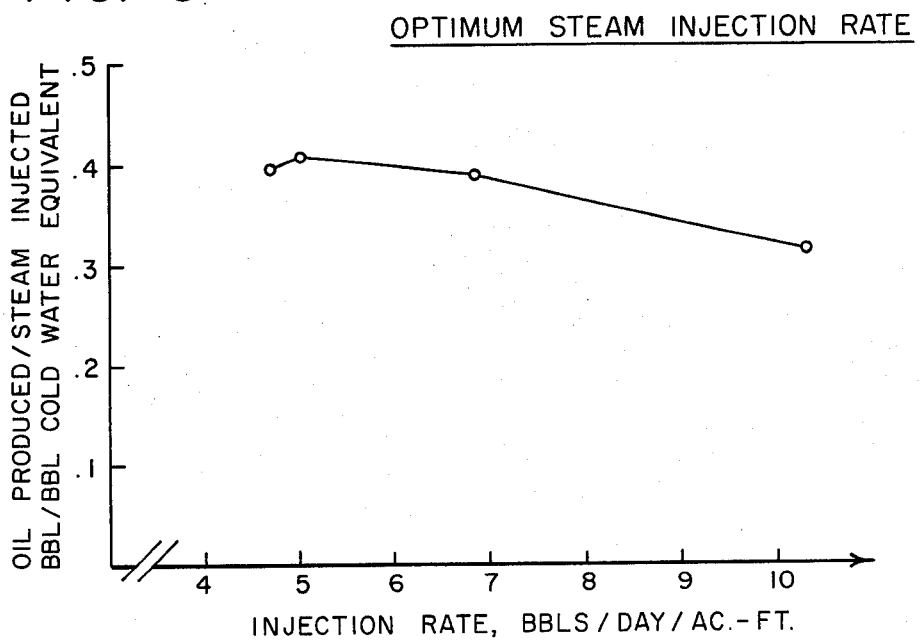
FIG. 3 illustrates the percent oil recovery versus steam injection rate in bbls/day/ac.-ft. for an optimum slug size of steam equal to 0.37 pore volume.

Two wells separated by 467 feet are sunk into a formation 150 feet thick and containing a heavy crude having a viscosity of 61,900 cp at a formation temperature of 55° F. The bottom 20 feet of formation is a water sand having a water saturation of 0.88. After approximately five years of cyclic steam stimulation in both wells, the system is converted to a steam flood by making one well an injector and the other a producer. Optimum steam slug size for the formation was determined by a sensitivity study to be about 0.37 pore volume, the results of which are shown in FIG. 2.

EXAMPLE 2

In the same formation as Example 1, a sensitivity study was conducted to determine optimum slug injection rate using the optimum slug size of steam, 0.37 pore volume, as determined in Example 1. The results are shown in FIG. 2 wherein the optimum injection rate was determined to be about 5 bbl/day/ac.-ft.

EXAMPLE 3

Figure 4:
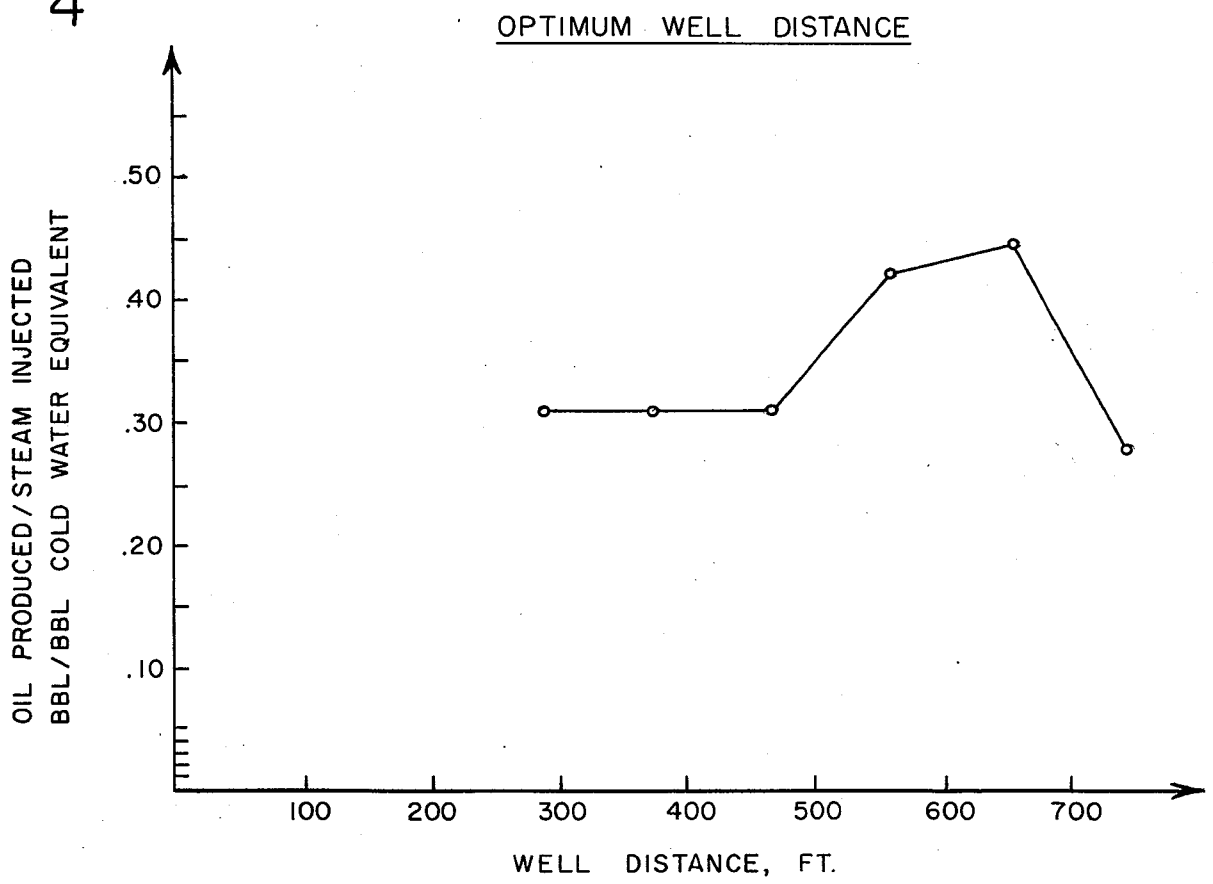
FIG. 4 illustrates the percent oil recovery versus well distance in feet.

In a similar formation to that in Example 1, without an underlying water zone, a sensitivity study was conducted to determine the effect of well distance on the amount of oil produced. These results are shown in FIG. 4 which show that the optimum well distances range from about 400 to 750 feet.

By the term "pore volume" as used herein, it is meant that volume of the portion of the formation underlying the well pattern employed as described in greater detail in U.S. Pat. No. 3,927,716 to Burdyn et al, the disclosure of which is hereby incorporated by reference.

From the foregoing specification one skilled in the art can readily ascertain the essential features of this invention and without departing from the spirit and scope thereof can adapt it to various diverse applications. It is our intention and desire that our invention be limited only by those restrictions or limitations as are contained in the claims appended immediately hereinafter below.

What is claimed is:

1. A method for the recovery of oil from a subterranean, viscous oil-containing formation penetrated by at least one injection well in fluid communication with the lower 50% or less of the formation, at least one spaced-apart production well in fluid communication with the upper 50% or less of the formation, said injection well and said production well having a communication relationship in the bottom zone of the formation and the wells spaced-apart a predetermined distance, comprising:

(a) injecting about 0.37 pore volume of steam at an injection rate of about 5.0 barrels of steam per day per acre-foot into the formation; p1 (b) injecting a predetermined amount of steam at a predetermined injection rate into the formation via said injection well and recovering fluids including oil from the formation via said production well;

(c) shutting-in said injection well and continuing to recover fluids including oil from the formation via said production well for a predetermined period of time;

(d) injecting a predetermined amount of a fluid comprising hot water into the formation via said injection well at a predetermined rate, said fluid injected in an amount and at an injection rate less than that of the steam injected during step (b); and (e) continuing to recover fluids including oil from the formation via said production well until the recovered fluids contain an unfavorable amount of steam or water.

2. The method of claim 1 wherein the amount of fluid injected into the injection well during step (d) is within the range of 0.03 to 0.10 pore volume and the injection rate is within the range of 1 to 2.0 barrels per day per acre-foot.

3. The method of claim 1 wherein the fluid injected into the injection well during step (d) is steam having a quality not greater than 20%.

4. The method of claim 1 wherein fluids including oil are recovered from the production well during step (e) until the fluids being recovered including oil contain at least 90% water or steam.

5. A method for the recovery of oil from a subterranean, viscous oil-containing formation penetrated by at least one injection well in fluid communication with the lower 50% or less of the formation, and at least one spaced-apart production well in fluid communication with the upper 50% or less of the formation, said injection well and said production well having a communication relationship in the bottom zone of the formation, comprising:

(a) spacing apart said injection and production well a distance within the range of 400 to 750 feet;

(b) injecting a predetermined amount of steam at a predetermined injection rate into the formation via said injection well and recovering fluids including oil from the formation via said production well;

(c) shutting-in said injection well and continuing to recover fluids including oil from the formation via said production well for a predetermined period of time;

(d) injecting a predetermined amount of a fluid comprising hot water into the formation via said injection well at a predetermined rate, said fluid injected in an amount and at an injection rate less than that of the steam injected during step (b); and (e) continuing to recover fluids including oil from the formation via said production well until the recovered fluids contain an unfavorable amount of steam or water.

6. The method of claim 5 wherein the amount of steam injected into the injection well during step (b) is within the range of 0.30 to 0.5 pore volume and the injection rate is within the range of 4.0 to 7.0 barrels per day per acre-foot.

7. The method of claim 5 wherein the amount of steam injected into the injection well during step (b) is 0.37 pore volume and the injection rate is 5.0 barrels per day per acre-foot.

8. The method of claim 5 wherein the amount of fluid injected into the injection well during step (d) is within the range of 0.03 to 0.10 pore volume and the injection rate is within the range of 1 to 2.0 barrels per day per acre-foot.

9. The method of claim 5 wherein the fluid injected into the injection well during step (d) is steam having a quality not greater than 20%.

10. The method of claim 5 wherein fluids including oil are recovered from the production well during step (e) until the fluids being recovered including oil contain at least 90% water or steam.

* * * * *